US011387025B2

(12) United States Patent
Omura et al.

(10) Patent No.: US 11,387,025 B2
(45) Date of Patent: Jul. 12, 2022

(54) GRAIN-ORIENTED ELECTRICAL STEEL SHEET AND PRODUCTION METHOD THEREFOR

(71) Applicant: JFE STEEL CORPORATION, Tokyo (JP)

(72) Inventors: Takeshi Omura, Tokyo (JP); Hirotaka Inoue, Tokyo (JP); Shigehiro Takajo, Tokyo (JP)

(73) Assignee: JFE STEEL CORPORATION, Chiyoda-ku (JP)

( * ) Notice: Subject to any disclaimer, the term of this patent is extended or adjusted under 35 U.S.C. 154(b) by 156 days.

(21) Appl. No.: 16/487,994

(22) PCT Filed: Feb. 20, 2018

(86) PCT No.: PCT/JP2018/006040
§ 371 (c)(1),
(2) Date: Aug. 22, 2019

(87) PCT Pub. No.: WO2018/159390
PCT Pub. Date: Sep. 7, 2018

(65) Prior Publication Data

US 2020/0035392 A1 Jan. 30, 2020

(30) Foreign Application Priority Data

Feb. 28, 2017 (JP) ..... JP2017-037495

(51) Int. Cl.
*H01F 1/18* (2006.01)
*C21D 8/12* (2006.01)
(Continued)

(52) U.S. Cl.
CPC ..... *H01F 1/18* (2013.01); *C21D 8/1222* (2013.01); *C21D 8/1266* (2013.01);
(Continued)

(58) Field of Classification Search
CPC ..... H01F 1/18; C21D 8/1222
(Continued)

(56) References Cited

U.S. PATENT DOCUMENTS 4,293,350 A 10/1981 Ichiyama et al.
6,482,271 B2 11/2002 Sakai et al.
(Continued)

FOREIGN PATENT DOCUMENTS

CN 1761764 A 4/2006
CN 104024454 A 9/2014
(Continued)

OTHER PUBLICATIONS

Dec. 7, 2020, Office Action issued by the Canadian Intellectual Property Office in the corresponding Canadian Patent Application No. 3,054,528.
(Continued)

*Primary Examiner* — Weiping Zhu
(74) *Attorney, Agent, or Firm* — Kenja IP Law PC

(57) ABSTRACT

Disclosed is a grain-oriented electrical steel sheet including: closure domains, each containing a discontinuous region at a part thereof and extending at an angle within 30° with respect to a transverse direction of the steel sheet, wherein a closure domain overlapping portion in the discontinuous region on one surface of the steel sheet has a length α in the transverse direction that is longer than a length β in the transverse direction of the closure domain overlapping portion on the other surface of the steel sheet, and the length α satisfies $0.5 \leq \alpha \leq 5.0$ and the length β satisfies $0.2\alpha \leq \beta \leq 0.8\alpha$. Consequently, the iron loss and the deterioration of magnetostrictive properties are suppressed in discontinuous regions, which would be inevitably formed when magnetic domain refining treatment is performed using a plurality of irradiation devices.

3 Claims, 9 Drawing Sheets

(51) Int. Cl.
*C22C 38/00* (2006.01)
*C22C 38/02* (2006.01)
*H01F 1/147* (2006.01)

(52) U.S. Cl.
CPC ..... *C21D 8/1272* (2013.01); *C21D 8/1283* (2013.01); *C21D 8/1294* (2013.01); *C22C 38/002* (2013.01); *C22C 38/02* (2013.01); *H01F 1/147* (2013.01); *C21D 2201/05* (2013.01)

(58) Field of Classification Search
USPC ..... 148/113
See application file for complete search history.

(56) References Cited

U.S. PATENT DOCUMENTS

| | | | | |
|---|---|---|---|---|
| 7,442,260 | B2 | 10/2008 | Sakai et al. | |
| 7,763,120 | B2 | 7/2010 | Sakai et al. | |
| 9,536,658 | B2 | 1/2017 | Omura et al. | |
| 9,646,749 | B2 | 5/2017 | Suehiro et al. | |
| 9,799,432 | B2 | 10/2017 | Yamaguchi et al. | |
| 9,984,800 | B2 | 5/2018 | Takajo et al. | |
| 10,147,527 | B2 | 12/2018 | Takajo et al. | |
| 10,704,113 | B2 * | 7/2020 | Inoue | B23K 26/0006 |
| 2013/0206283 | A1 | 8/2013 | Inoue et al. | |
| 2015/0310973 | A1 | 10/2015 | Takajo et al. | |
| 2016/0333435 | A1 | 11/2016 | Inoue et al. | |
| 2017/0313887 | A1 | 11/2017 | Kwon et al. | |
| 2018/0037965 | A1 | 2/2018 | Takajo et al. | |

FOREIGN PATENT DOCUMENTS

| | | | | |
|---|---|---|---|---|
| CN | 104093870 | A | 10/2014 | |
| CN | 106414779 | A * | 2/2017 | C22C 38/02 |
| CN | 106414779 | A | 2/2017 | |
| EP | 2602340 | A1 | 6/2013 | |
| EP | 2602344 | A1 | 6/2013 | |
| EP | 3098328 | A1 | 11/2016 | |
| JP | S572252 | B2 | 1/1982 | |
| JP | H11279645 | A | 10/1999 | |
| JP | H11279654 | A | 10/1999 | |
| JP | 2002012918 | A | 1/2002 | |
| JP | 2007277644 | A | 10/2007 | |
| JP | 2012036442 | A | 2/2012 | |
| JP | 2012036445 | A | 2/2012 | |
| JP | 2012036450 | A | 2/2012 | |
| JP | 2012172191 | A | 9/2012 | |
| JP | 2015052144 | A | 3/2015 | |
| JP | 2016156047 | A | 9/2016 | |
| KR | 1020160057753 | A | 5/2016 | |
| WO | 2012164702 | A1 | 12/2012 | |
| WO | 2013099258 | A1 | 7/2013 | |
| WO | 2014068962 | A1 | 5/2014 | |
| WO | 2015111434 | A1 | 7/2015 | |

OTHER PUBLICATIONS

Nov. 7, 2019, the Extended European Search Report issued by the European Patent Office in the corresponding European Patent Application No. 18761106.6.

May 22, 2018, International Search Report issued in the International Patent Application No. PCT/JP2018/006040.

Sep. 22, 2020, Office Action issued by the China National Intellectual Property Administration in the corresponding Chinese Patent Application No. 201880014003.7 with English language search report.

* cited by examiner

GRAIN-ORIENTED ELECTRICAL STEEL SHEET AND PRODUCTION METHOD THEREFOR

TECHNICAL FIELD

This disclosure relates to a grain-oriented electrical steel sheet and a production method therefor, and more particularly to a grain-oriented electrical steel sheet suitable for transformer core material and a production method therefor.

BACKGROUND

Transformers in which grain-oriented electrical steel sheets are used are required to have low iron loss and low noise properties. Here, to reduce the iron loss of the transformer, it is effective to reduce the iron loss of the grain-oriented electrical steel sheet itself, and one of the techniques therefor includes refining the magnetic domains by irradiating a surface of the steel sheet with a laser beam, a plasma beam, an electron beam, or the like. For example, JPS57-2252B (PTL 1) proposes a technique for reducing the iron loss of a steel sheet by irradiating the steel sheet after final annealing with a laser beam, applying a region with a high dislocation density to the surface of the steel sheet, and narrowing the magnetic domain width. Further, JP2012-036450A (PTL 2) describes a technique for reducing the iron loss of a grain-oriented electrical steel sheet by optimizing the irradiation point interval and the irradiation energy when applying thermal strain in a dot-sequence manner by electron beam irradiation in a direction intersecting with the rolling direction of the grain-oriented electrical steel sheet. This technique reduces iron loss by not only refining main magnetic domains but also forming an additional magnetic domain structure, called closure domains, inside the steel sheet.

However, as closure domains inside the steel sheet increase, the generation of noise becomes a problem when such steel sheet is incorporated into a transformer. The reason is that since the magnetic moment of closure domains is oriented in a plane orthogonal to the rolling direction, magnetostriction occurs as the orientation changes towards the rolling direction during the excitation process of the grain-oriented electrical steel sheet. Therefore, in order to achieve both low iron loss and low noise, it is necessary to optimize the closure domains newly formed by magnetic domain refinement.

In this respect, JP2012-172191A (PTL 3) teaches a technique for providing a grain-oriented electrical steel sheet exhibiting excellent iron loss properties and noise performance by adjusting, in the case of performing magnetic domain refining treatment by irradiating with an electron beam in point form, the relationship between holding time t at each irradiation point and interval X between irradiation points in accordance with the output of the electron beam. JP2012-036445A (PTL 4) describes a technique for optimizing the relationship between diameter A of the thermal strain application regions and irradiation pitch B in magnetic domain refining treatment by electron beam irradiation. Further, WO2014/068962 (PTL 5) describes a technique for optimizing, in accordance with an electron beam method, the width in the rolling direction, the thickness in the thickness direction, and the application interval in the rolling direction of closure domains.

CITATION LIST

Patent Literature

PTL 1: JPS57-2252B
PTL 2: JP2012-036450A
PTL 3: JP2012-172191A
PTL 4: JP2012-036445A
PTL 5: WO2014/068962
PTL 6: WO2015/111434

SUMMARY

Technical Problem

When high energy beams such as the above laser beam and electron beam are irradiated on the steel sheet surface, the beam scanning speed and the beam scanning width are restricted by various factors, which fact makes it difficult to perform magnetic domain refining treatment on the entire surface of the coil with a single device. In this case, a plurality of irradiation devices are connected in the sheet transverse direction of a coil such that beam irradiation from each device is connected in the sheet transverse direction of the coil, whereby beam irradiation over the entire width of the coil is achieved. However, when a plurality of irradiation devices are used in this way, "discontinuous regions" of the closure domains are generated at the boundary between the irradiation regions covered by the respective beam irradiation devices. Here, when the irradiation regions of adjacent electron beams overlap, these regions appear as a continuous closure domain. However, since the amount of energy application in the overlapping portion is different from that in the portion irradiated continuously by a single electron gun, the continuity of the closure domain structure is interrupted. Therefore, as used herein, a closure domain part where the adjacent electron beam irradiation regions overlap is also defined as a "discontinuous region" together with a part where the closure domains do not directly overlap.

Since the magnetic domain structure of the steel sheet becomes uneven around this discontinuous region, it is more difficult to achieve both low iron loss and low noise of the transformer. Further, all the techniques relating to the closure domain described above focus on regions other than the discontinuous regions, and these techniques can not be directly applied to the periphery of the discontinuous regions.

In this respect, WO2015/111434 (PTL 6) teaches a technique focusing on the periphery of the discontinuous regions. PTL 6 describes a technique for providing a steel sheet with low iron loss properties by optimizing the overlapping width in the TD direction (sheet transverse direction) of discontinuous regions. However, although the technique of PTL 6 achieves low iron loss of the steel sheet, control is provided only in the direction in which the irradiation area of each electron gun overlaps with that of another electron gun, the overlapping width does not change in an electron gun irradiation surface and in a non-irradiation surface, and thus the magnetostrictive properties that are more sensitive to the influence of strain deteriorate more severely than in the region not including a discontinuous region. Moreover, although the deterioration of the iron loss is suppressed, there still remains the problem that the iron loss properties are not always the same in each region not including the discontinuous region.

It would thus be helpful, in particular, to provide a grain-oriented steel sheet suppressing both the iron loss and the deterioration of the magnetostrictive properties in discontinuous regions, which would be inevitably formed when magnetic domain refining treatment is performed using a plurality of irradiation devices, and a production method therefor.

Solution to Problem

The distribution of strain applied to a steel sheet by beam irradiation is known to influence the iron loss and magnetostrictive properties. The inventors found that as an index for evaluating this strain distribution, it is suitable to compare magnetic domain discontinuous regions in the steel sheet surface irradiated with the beam and in the rear surface not irradiated with the beam. The inventors also found that the proper state of closure domains is different between the periphery of the discontinuous regions and the other portion, that is, the proper beam irradiation conditions are different between the periphery of the discontinuous regions and the other portion, and this difference causes the difference in form in the thickness direction between the closure domains.

The following provides a description of the configuration required to make the iron loss properties and the magnetostrictive properties in the periphery of discontinuous regions comparable to those in regions that are not discontinuous regions (i.e., continuous regions).

1) a grain-oriented electrical steel sheet in which discontinuous regions of closure domains are present in the TD direction which is a direction orthogonal to the rolling direction, and overlapping margins in the TD direction of closure domains in the beam-irradiation surface and in the non-beam-irradiation surface satisfy:

$$0.5 \leq \alpha \leq 5.0 \quad (1)$$

$$0.2\alpha \leq \beta \leq 0.8\alpha \quad (2)$$

Here, $\alpha$ is the overlapping width of the lengths in the TD direction of adjacent closure domains in the beam-irradiation surface (hereinafter, the unit of $\alpha$ is in millimeters [mm]), and $\beta$ is an overlapping width of the lengths in the TD direction of adjacent closure domains in the non-beam-irradiation surface (hereinafter, the unit of $\beta$ is in millimeters [mm]).

2) When applying thermal energy to the steel sheet surface by installing a plurality of high energy beam irradiation devices (a plurality of laser beam irradiation devices or a plurality of electron beam irradiation devices), the control of the state of closure domains in the beam-irradiation surface/non-beam-irradiation surface is performed by changing at least one of the parameters for adjusting the beam focus of each irradiation device in accordance with the deflection of the beam.

3) Instead of or in addition to 2), when applying heat energy to the steel sheet surface by installing a plurality of high energy beam irradiation devices, control of the state of closure domains in the beam-irradiation surface and in the non-beam-irradiation surface is performed by adjusting at least one of the parameters for adjusting the beam output of each irradiation device in accordance with the beam deflection.

The above $\alpha$ and $\beta$ can be determined by a magnet viewer capable of visualizing a magnetic domain pattern using magnetic colloid. FIGS. 1 and 2 are schematic views of the results of the magnetic domain observation. As used herein, a region present in such a manner as to divide main magnetic domains is defined as a closure domain (indicated by reference numerals 1 to 3 in FIG. 1). Further, the closure domains formed in the adjacent electron beam irradiation regions are defined as adjacent closure domains (indicated by reference numerals 2 and 3 in FIG. 1). As illustrated in FIG. 1, when the overlapping width of adjacent closure domains is positive (i.e., when adjacent closure domains overlap), this means that there is no region where the main magnetic domain is not divided by the closure domains. As illustrated in FIG. 2, when the overlapping width of adjacent closure domains is negative (i.e., when adjacent closure domains does not overlap), this indicates that there is a region where the main magnetic domain is not divided by the closure domains.

Furthermore, as used herein, the overlapping width $\alpha$ denotes the length in the transverse direction (direction orthogonal to the rolling direction) of the overlapping portion of adjacent magnetic domains in the irradiation surface (also referred to herein as "one surface") of the steel sheet, as denoted by $\alpha$ and $\beta$ in FIG. 1. As used herein, the overlapping width $\beta$ denotes the length in the transverse direction of the overlapping portion in the non-irradiation surface (also referred to herein as "the other surface") of the steel sheet corresponding to the above $\alpha$. Here, $\alpha$ and $\beta$ both represent the length in the transverse direction of the overlapping portion of the closer (narrower) ones of adjacent magnetic domains. Also, when adjacent magnetic domains are in close proximity with the same width, that value is naturally adopted.

Next, the background of the present disclosure will be described in detail.

<Experiment 1>

First, using a plurality of electron beam irradiation devices, magnetic domain refining treatment was performed on a commercially available grain-oriented electrical steel sheet (0.25 mm thick) under the irradiation conditions No. 1 (beam current: 4 mA) to No. 9 (beam current: 20 mA), including the irradiation line interval: 4.0 mm, accelerating voltage: 100 kV, scanning rate: 70 m/sec, beam current: changed by 2 mA in the range of 4 mA to 20 mA.

From this coil, a test material of 100 mm wide and 300 mm long including discontinuous regions and a test material of 100 mm wide and 300 mm long not including discontinuous regions are respectively collected to evaluate the magnetic properties by the method of measurement of the magnetic properties by means of a single sheet tester specified in JIS C 2556. Another important property, magnetostriction, was evaluated by measuring the contraction of each steel sheet using a laser doppler vibrometer with an index called magnetostrictive vibration acceleration level in accordance with the method described in *Kawasaki Steel Technical Report* Vol. 29 No. 3 pp. 164-168 (1997). In this case, the magnetostrictive harmonic components from 100 Hz to 2000 Hz were integrated, and the maximum magnetic flux density at the time of magnetostriction measurement was set to 1.5 T which is considered to have the highest correlation with the transformer noise with a maximum magnetic flux density of 1.3 T to 1.8 T.

The evaluation results of the iron loss properties are illustrated in FIG. 3. Further, FIG. 4 illustrates the evaluation results of the magnetostrictive properties.

As illustrated in FIG. 3, in the test materials with and without discontinuous regions, the irradiation conditions exhibiting good iron loss properties are different, but the iron loss levels obtained under the respective irradiation conditions exhibiting good iron loss properties were almost the same. Further, as illustrated in FIG. 4, with regard to the magnetostrictive properties, the tendency that the properties deteriorate as the irradiation condition number becomes larger was the same in the test materials with and without discontinuous regions. The magnetostrictive properties are known to be highly strain sensitive. That is, from the results of FIG. 4, it is considered that the strain application ability under each irradiation condition is increased as the irradiation condition number becomes larger, that is, as the beam current becomes higher. In particular, in the test materials with discontinuous regions, the magnetostrictive property was deteriorated more severely than in the test materials without discontinuous regions depending on the conditions. It was revealed from FIGS. 3 and 4 that not all the conditions necessarily exhibit good magnetostrictive properties even under the conditions exhibiting good iron loss properties, and that the conditions under which the iron loss and magnetostrictive properties are compatible are more limited than those exhibiting good iron loss properties.

Next, in the test materials with discontinuous regions, the behavior against the change of the beam current in terms of both the iron loss and magnetostrictive properties was different from that in the test materials without discontinuous regions. Then, in order to investigate the cause, closure domain observation was performed on each of the electron-beam-irradiation surface (front surface) and the non-electron-beam-irradiation surface (rear surface) for the test materials with discontinuous regions. That is, the magnitudes of $\alpha$ and $\beta$ were respectively investigated.

FIG. 5 illustrates the overlapping widths $\alpha$ and $\beta$ of closure domains.

The observation from the irradiation surface exhibited no significant difference depending on the irradiation conditions, but on the non-irradiation surface, the result was largely different depending on the irradiation conditions. In this case, since a closure domain is formed by the strain in the steel sheet, a large difference in the closure domain overlapping width between the irradiation surface and the non-irradiation surface means that the strain amount is largely different between the irradiation surface and the non-irradiation surface.

The overlapping width of the non-irradiation surface was reduced under many irradiation conditions because the strain introduced from the irradiation surface is unlikely to spread in the thickness direction.

From these results, the behavior of the test materials with discontinuous regions in FIG. 3 can be described as follows.

In a region where the closure domains overlap, the irradiation interval in the rolling direction is narrower than in a region without discontinuous regions, as the irradiation beams from different beam irradiation devices deviate from each other in the rolling direction. It is thus considered that the irradiation condition Nos. 7, 8, and 9 having high strain application ability applied strain more than necessary, the hysteresis loss was greatly deteriorated, and the iron loss was increased. Note that the irradiation condition Nos. 4, 5, and 6 exhibited proper strain amount in the region where the irradiation beam interval was narrow. It is also considered that under the irradiation condition Nos. 1, 2, and 3, the strain application amount was low and the strain amount was insufficient, and a sufficient magnetic domain refining effect could not be obtained, causing deterioration of the iron loss. With regard to the magnetostrictive properties, it is considered that the appropriate range of the strain application state is more limited than in the case of the iron loss since the magnetostrictive properties are highly strain sensitive.

From the above results, it is important to control the three-dimensional strain distribution (i.e., the strain distribution including the thickness direction) in order to control the material properties in the vicinity of discontinuous regions to a good state. It can be seen that it is useful to use not only the overlapping width of closure domains in the irradiation surface alone, but in combination with the overlapping width of closure domains in the non-irradiation surface as the control parameters.

Experiment 2

From the results of Experiment 1, the inventors considered that in order to obtain an appropriate strain distribution in the thickness direction of discontinuous regions, it is preferable to control the overlapping widths of closure domains on the front and back sides of the steel sheet as parameters. First, magnetic domain refining treatment was performed on a known grain-oriented electrical steel sheet (0.30 mm thick) using four electron guns. The irradiation conditions included acceleration voltage: 150 kV, scanning speed: 64 m/sec, beam current: 5.0 mA, irradiation line interval in RD direction (rolling direction): 4.5 mm, irradiation area of each electron gun: equally divided, and closure domain overlapping width (overlapping width of beam polarization distance): 0.1 mm to 10.0 mm.

At this time, in order to control the closure domain overlapping widths in the beam-irradiation surface and in the non-beam-irradiation surface, the current value of the focusing coil controlling the focusing was changed according to the deflection position. In addition, the current value of the focusing coil was set so as to achieve just focusing in regions other than the discontinuous regions, and the current value of the focusing coil was changed so as to satisfy various focusing conditions in the discontinuous regions. As used herein, "focusing" refers to the focus of the beam, and "just focusing" refers to the focus of the beam being in the state in which strain is most easily introduced, specifically, in which the beam converges on the steel sheet to the greatest degree.

FIG. 6 illustrates the relationship between the iron loss and the closure domain overlapping ratio ($\beta/\alpha$) when the closure domain overlapping width on the irradiation surface is changed. Note that with respect to the horizontal axis in FIG. 6, a point at which the overlapping ratio is "−1" or "−2" means not overlapping (negative) on the non-irradiation surface and overlapping (positive) on the irradiation surface. It was found that particularly good iron loss properties were exhibited when the ratio of the irradiation surface to the non-irradiation surface was 0.2 to 0.9 in the case where the closure domain overlapping width was 4.0 mm. The iron loss properties were comparable to those of a test material without discontinuous regions evaluated as a reference.

Next, evaluation was made of the magnetostrictive properties of the test material having a closure domain overlapping width of 4.0 mm in which a good iron loss property range was observed. The evaluation results are illustrated in FIG. 7. It was found that the compatibility between the iron loss properties and the magnetostrictive properties can be obtained when the ratio $\beta/\alpha$ of the overlapping width $\alpha$ on the irradiation surface to the overlapping width $\beta$ on the non-irradiation surface is 0.2 to 0.8, which is an even more limited range than in the condition exhibiting good iron loss properties.

Furthermore, the relationship between the closure domain overlapping width on the irradiation surface and the iron loss was investigated. The results are illustrated in FIG. 8. It was found that good properties (comparable to those of a sample without discontinuous regions) are exhibited in the case where the overlapping width on the irradiation surface is in the range of 0.5 mm to 6.0 mm. It was also found that a test material having a closure domain overlapping ratio ($\beta/\alpha$) of 0.46 is within the range in which the iron loss properties and the magnetostrictive properties are compatible as determined by the results of FIGS. 6 and 7. For this test material, the magnetostrictive properties were investigated, and the result is illustrated in FIG. 9. Among the samples illustrating good iron loss properties, it was found that those samples having an overlapping width in the range of 0.5 mm to 5.0 mm exhibit the magnetostrictive properties of the same level as the samples without discontinuous regions, and thus achieve the compatibility between the iron loss properties and the magnetostrictive properties.

From the above results, the following points were made clear. That is, it was revealed that for a test material with discontinuous regions, the strain distribution control in the steel sheet is insufficient by controlling only the beam scanning width and the closure domain overlapping width on the irradiation surface. It was also revealed that it is important to consider the strain distribution in the thickness direction of the steel sheet as the evaluation index of the closure domain overlapping widths on the irradiation surface and the non-irradiation surface.

The present disclosure is based on the above novel findings, and primary features thereof can be summarized as follows.

1. A grain-oriented electrical steel sheet comprising: closure domains, each containing a discontinuous region at a part thereof and extending at an angle within 30° with respect to a transverse direction of the steel sheet, wherein a closure domain overlapping portion in the discontinuous region on one surface of the steel sheet has a length $\alpha$ in the transverse direction that is longer than a length $\beta$ in the transverse direction of the closure domain overlapping portion on the other surface of the steel sheet, and the length $\alpha$ satisfies the following Expression (1) and the length $\beta$ satisfies the following Expression (2):

$$0.5 \leq \alpha \leq 5.0 \quad (1)$$

$$0.2\alpha \leq \beta \leq 0.8\alpha \quad (2).$$

2. A method of producing a grain-oriented electrical steel sheet, comprising: irradiating the steel sheet with a high energy beam from each of a plurality of high energy beam irradiation devices to form closure domains, each containing a discontinuous region at a part thereof and extending at an angle within 30° with respect to a transverse direction of the steel sheet, wherein in each of the high energy beam irradiation devices, at least one of focusing and output of high energy beam is adjusted such that a closure domain overlapping portion in the discontinuous region on an irradiation surface of the steel sheet has a length $\alpha$ in the transverse direction that is longer than a length $\beta$ in the transverse direction of the closure domain overlapping portion on a non-irradiation surface of the steel sheet, and the length $\alpha$ satisfies the following Expression (1) and the length $\beta$ satisfies the following Expression (2):

$$0.5 \leq \alpha \leq 5.0 \quad (1)$$

$$0.2\alpha \leq \beta \leq 0.8\alpha \quad (2).$$

3. The method of producing a grain-oriented electrical steel sheet according to 2. above, wherein the high energy beam is a laser beam or an electron beam.

Advantageous Effect

According to the present disclosure, it is possible to provide, in particular, a grain-oriented electrical steel sheet in which deterioration of iron loss properties and magnetostrictive properties is effectively suppressed in discontinuous regions, which would be inevitably formed when magnetic domain refining treatment is performed using a plurality of irradiation devices, and a production method therefor.

DETAILED DESCRIPTION

Figure 1:
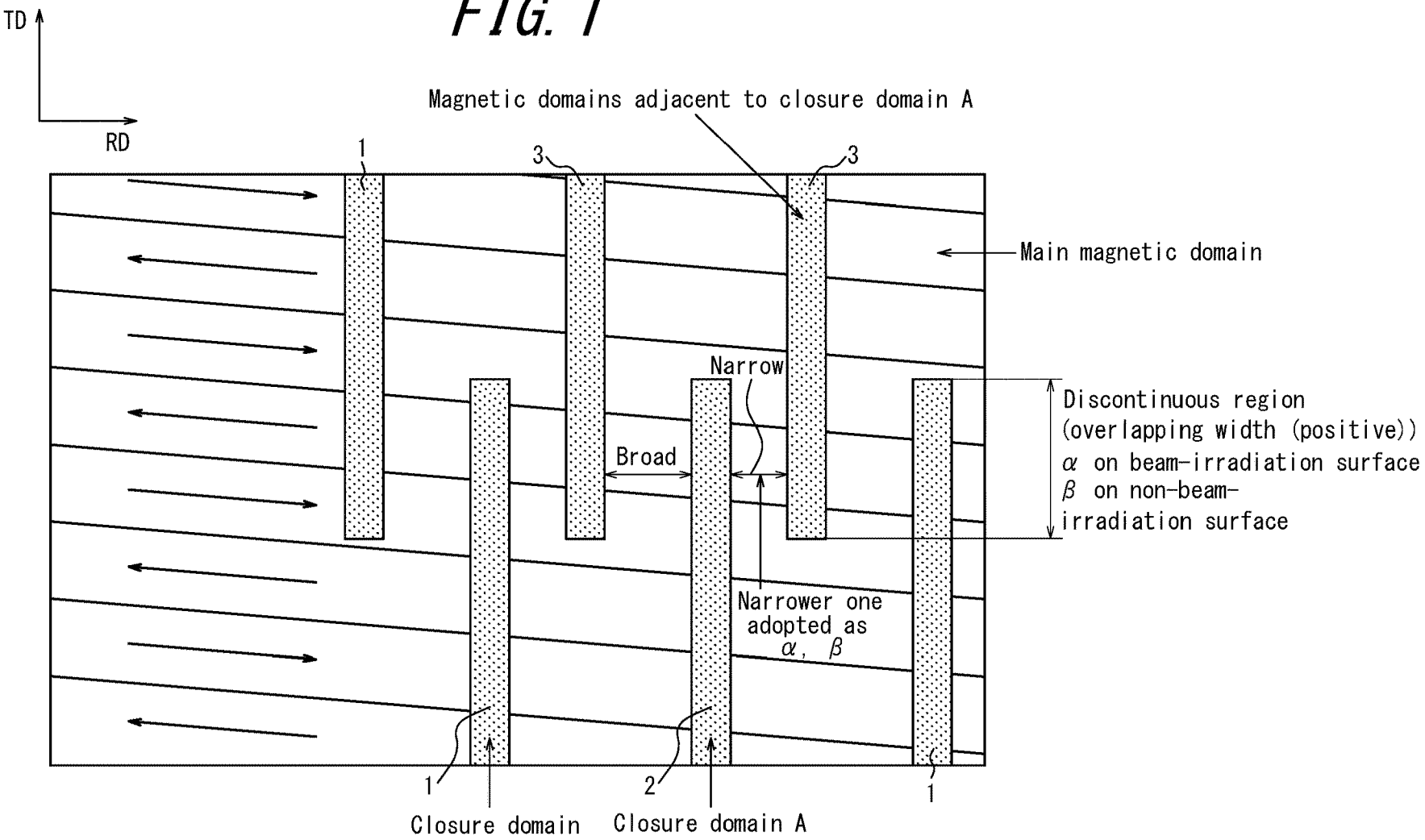
FIG. 1 is a schematic view illustrating the magnetic domain observation results.
Figure 2:
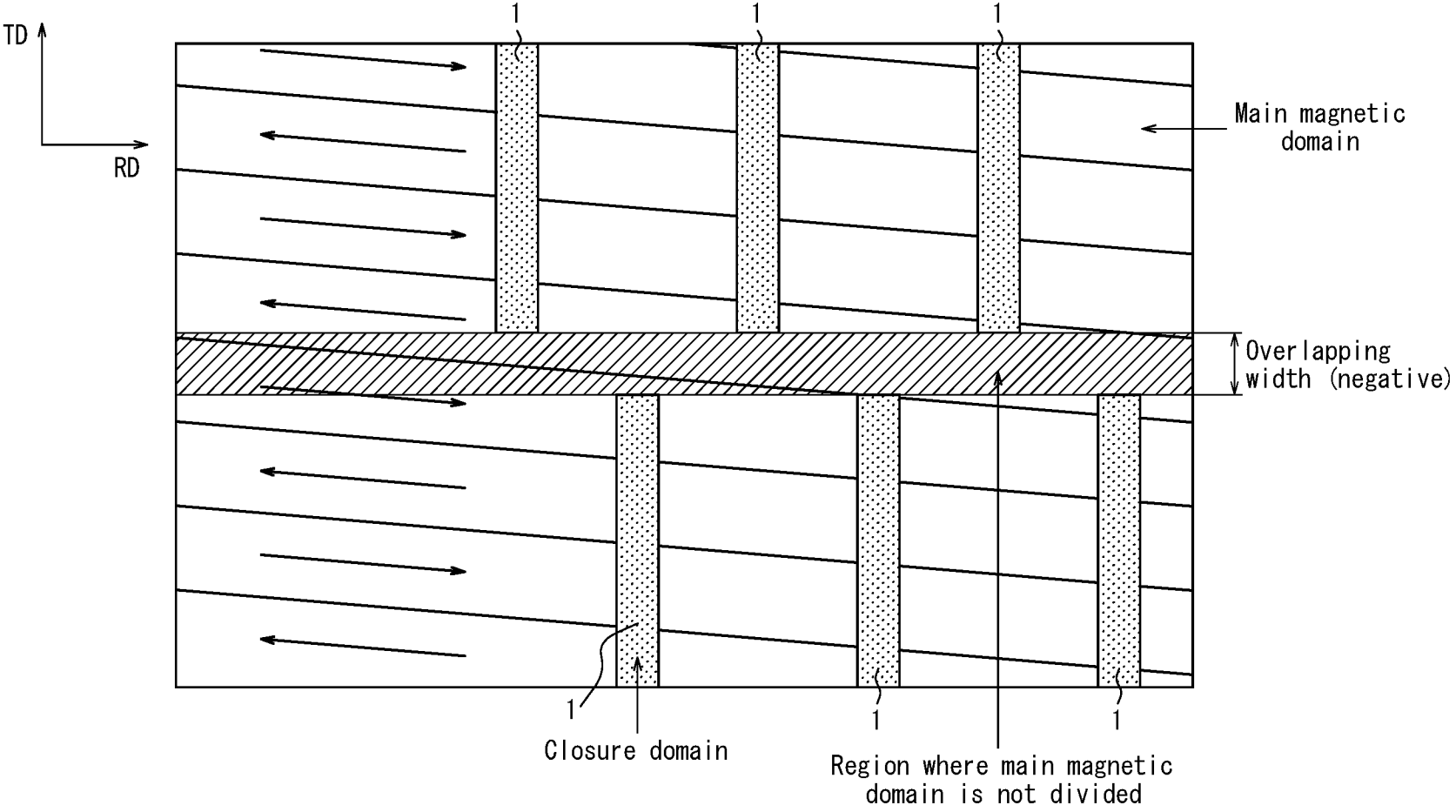
FIG. 2 is another schematic view illustrating the magnetic domain observation results.
Figure 3:
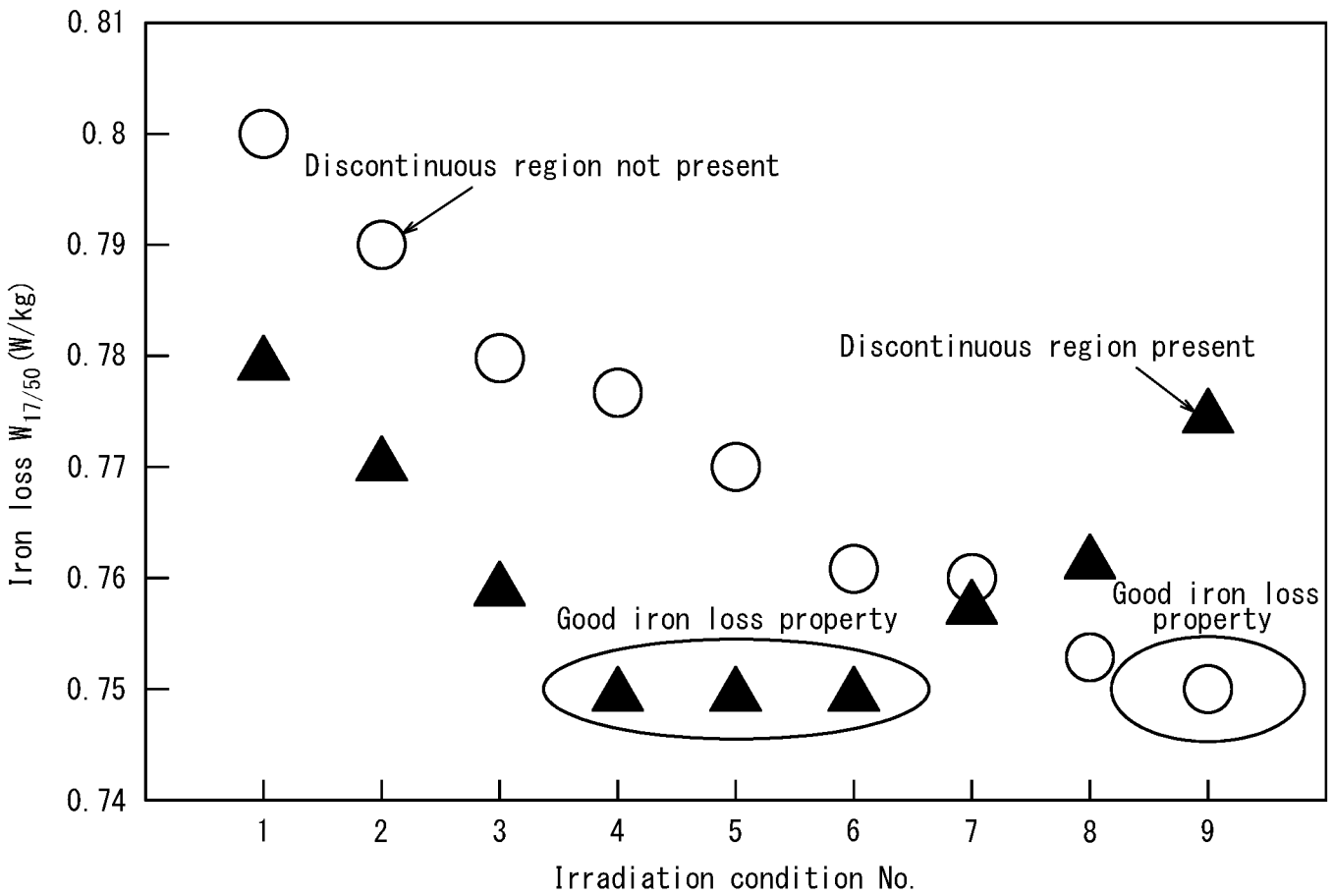
FIG. 3 is a graph illustrating the evaluation results of iron loss properties.
Figure 4:
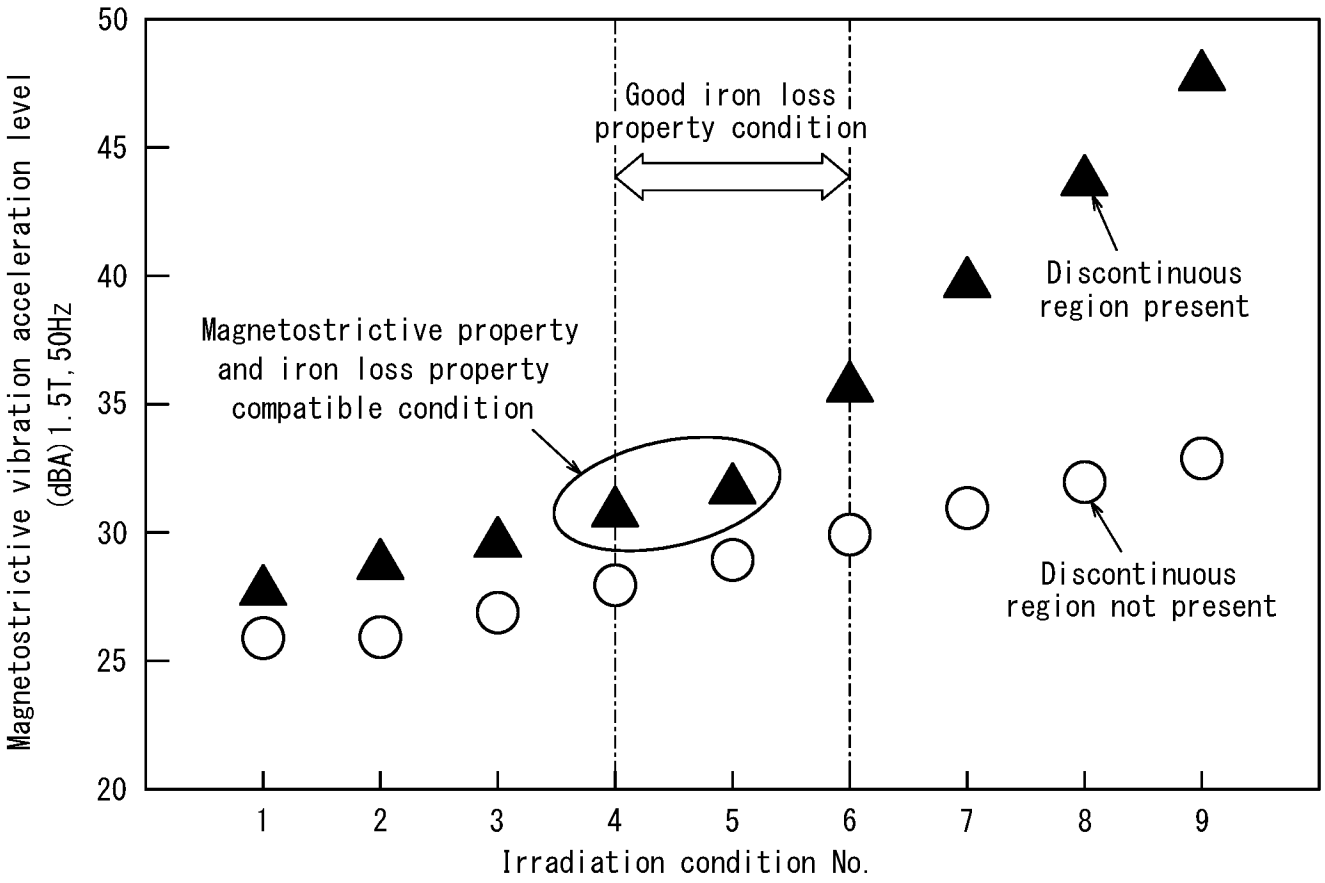
FIG. 4 is a graph illustrating the evaluation results of magnetostrictive properties.
Figure 5:
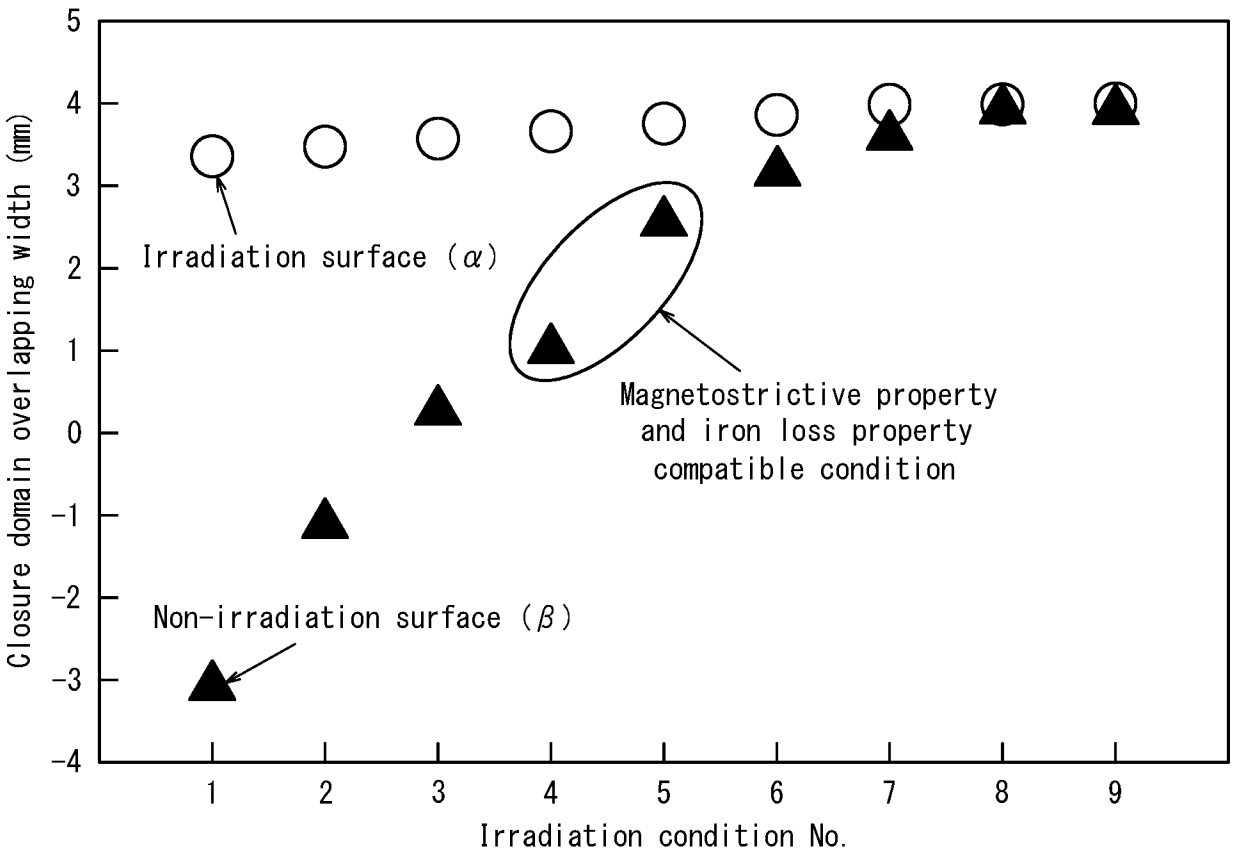
FIG. 5 is a graph illustrating the measurement results of closure domain overlapping widths.
Figure 6:
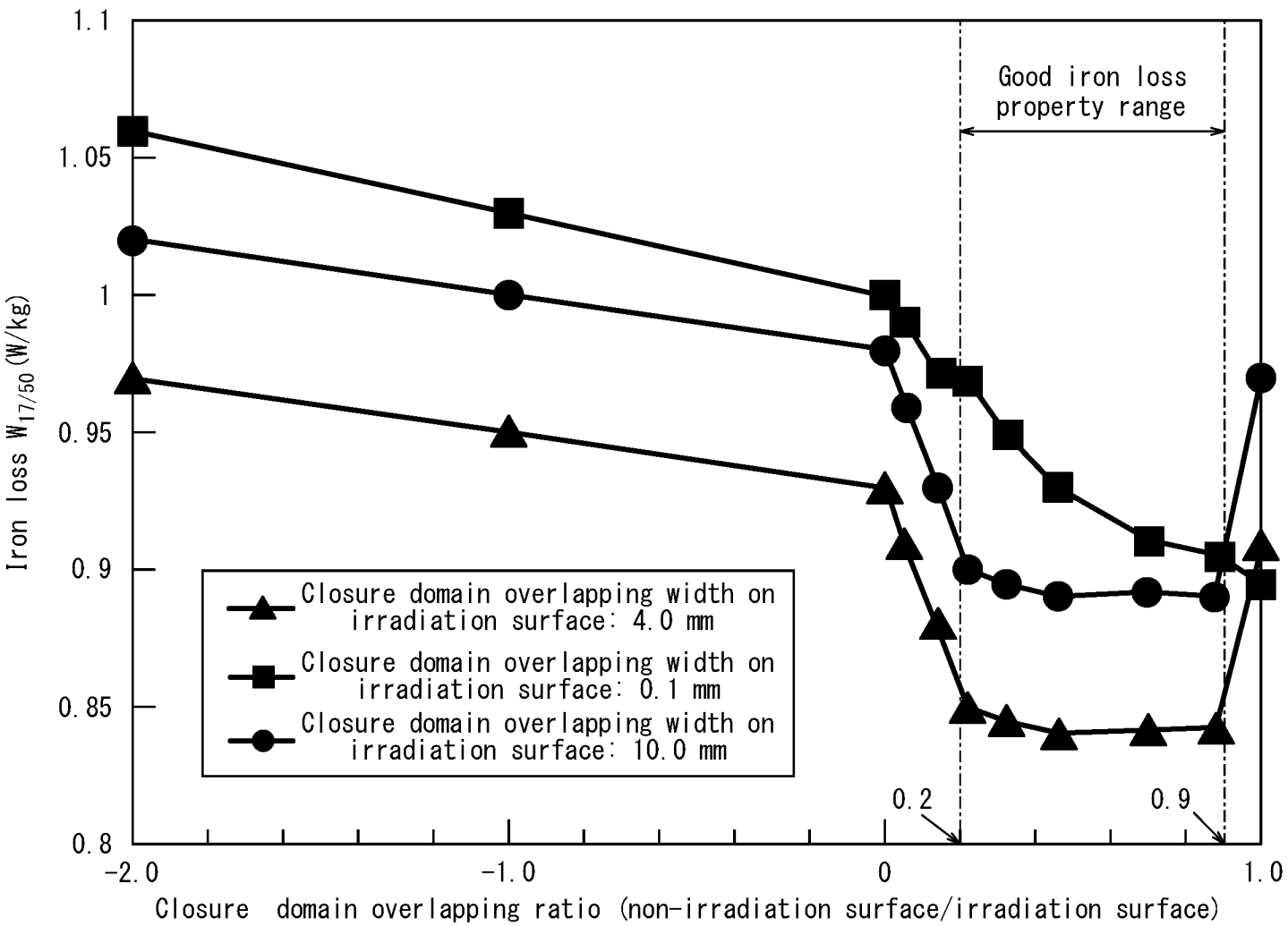
FIG. 6 is a graph illustrating the relationship between the iron loss and the closure domain overlapping ratio when the closure domain overlapping width on the irradiation surface is changed.
Figure 7:
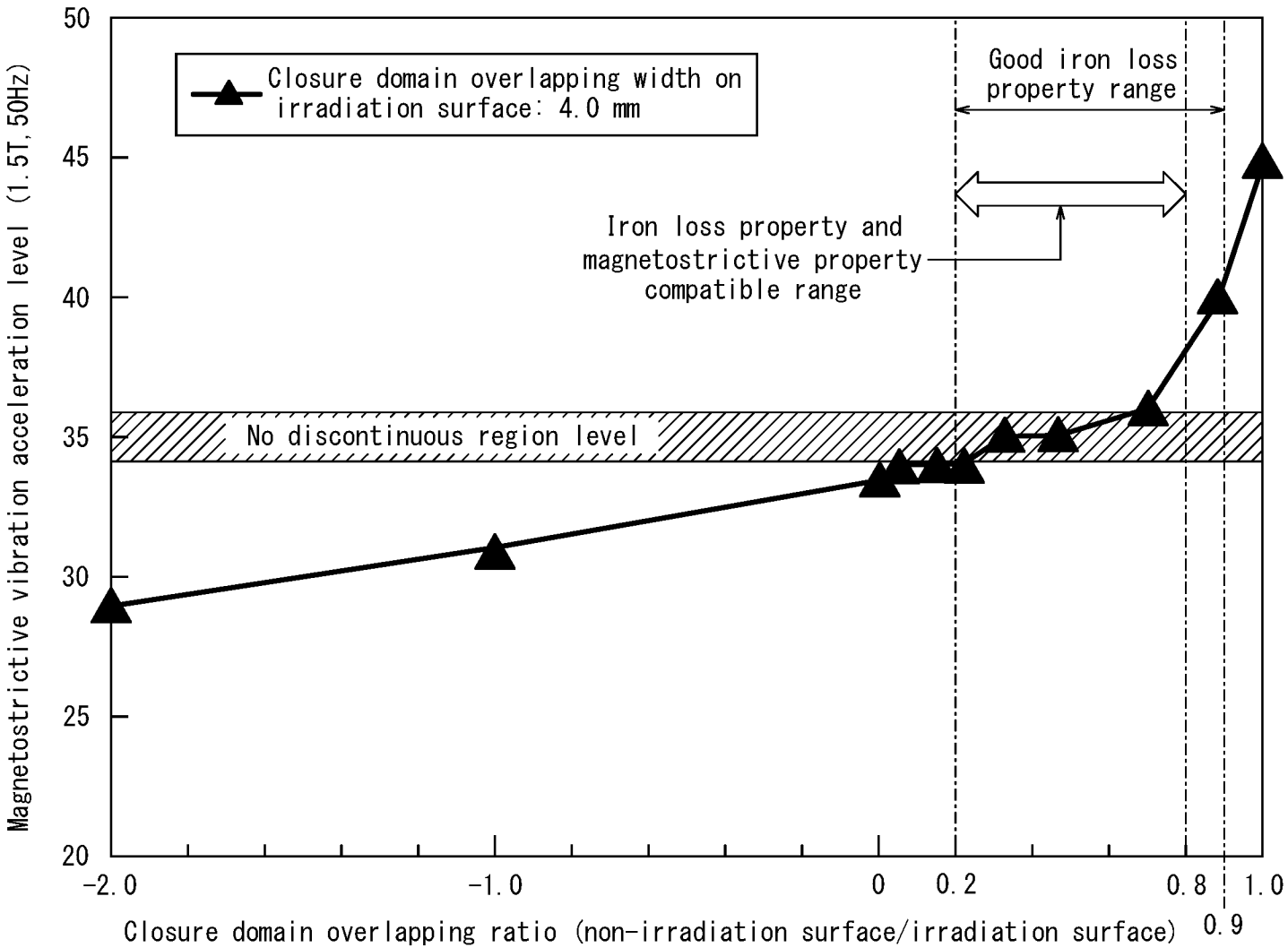
FIG. 7 is a graph illustrating the relationship between the magnetostrictive properties and the closure domain overlapping ratio.
Figure 8:
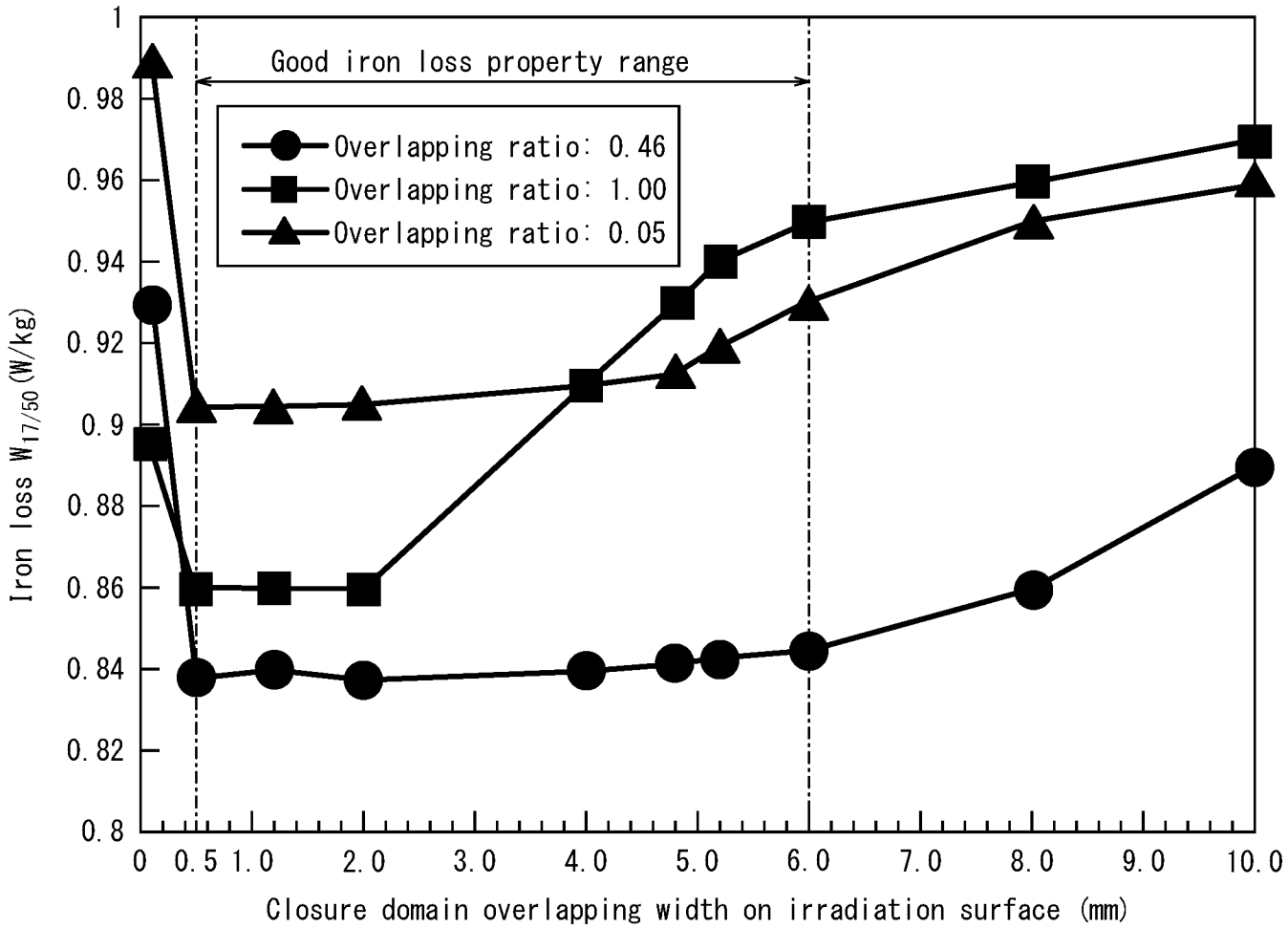
FIG. 8 is a graph illustrating the relationship between the iron loss and the closure domain overlapping width on the irradiation surface when the closure domain overlapping ratio of the irradiation surface is changed.
Figure 9:
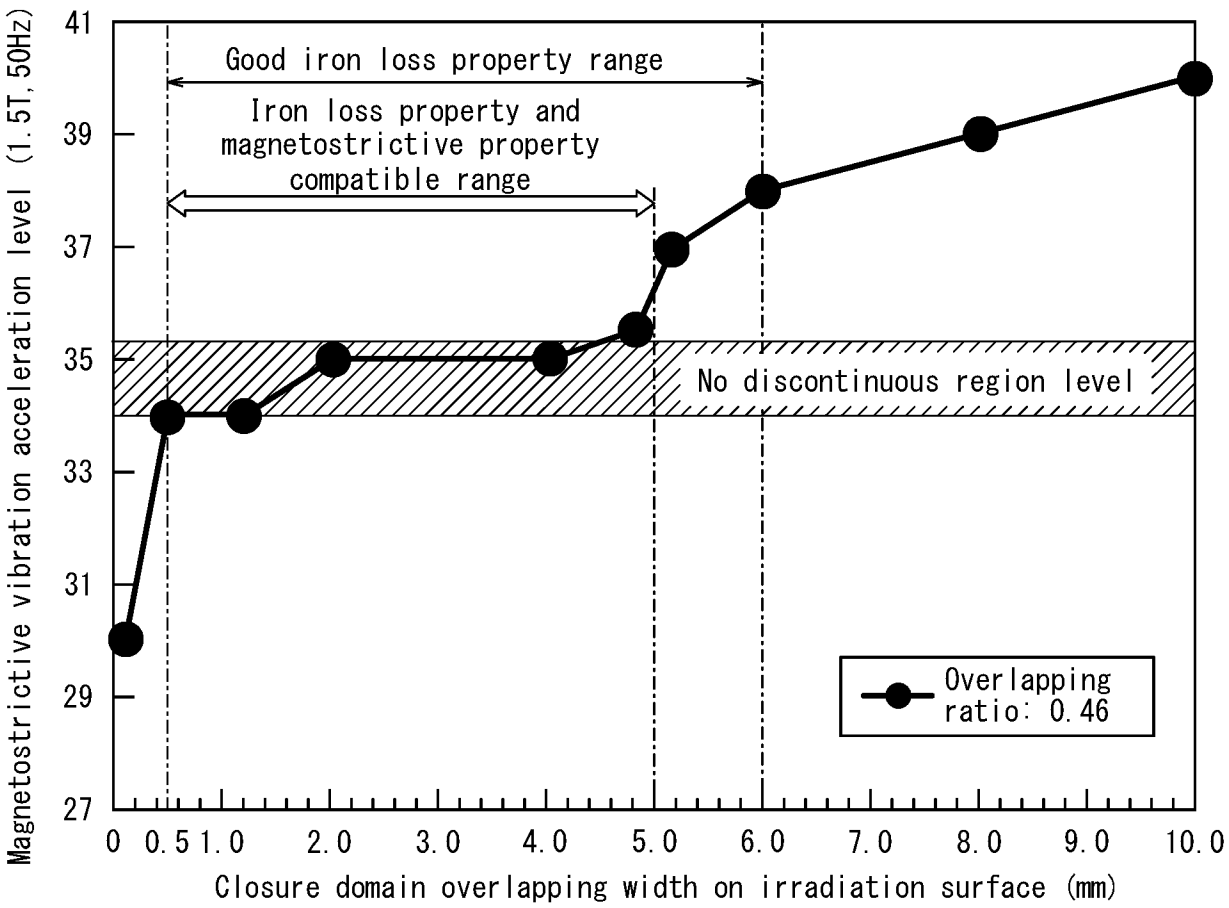
FIG. 9 is a graph illustrating the relationship between the magnetostrictive properties and the closure domain overlapping width on the irradiation surface.

The grain-oriented electrical steel sheet according to the present disclosure will be specifically described below.

[Chemical Composition]

In the present disclosure, the chemical composition of a slab for a grain-oriented electrical steel sheet may be any chemical composition as long as it causes secondary recrystallization. In addition, if an inhibitor, e.g., an AlN-based inhibitor is used, Al and N may be contained in an appropriate amount, respectively, while if a MnS/MnSe-based inhibitor is used, Mn and Se and/or S may be contained in an appropriate amount, respectively. Of course, both inhibitors may be used in combination. When inhibitors are used as described above, contents of Al, N, S and Se are preferably Al: 0.01 mass % to 0.065 mass %, N: 0.005 mass % to 0.012 mass %, S: 0.005 mass % to 0.03 mass %, and Se: 0.005 mass % to 0.03 mass %, respectively. Note that Al, N, S, and Se are purified in final annealing, and their contents in a product sheet are reduced to the level of inevitable impurities.

The present disclosure is also applicable to a grain-oriented electrical steel sheet not using any inhibitor and having restricted Al, N, S, and Se contents. In this case, the contents of Al, N, S, and Se are preferably limited to Al: 100 mass ppm or less, N: 50 mass ppm or less, S: 50 mass ppm or less, and Se: 50 mass ppm or less, respectively.

Specific examples of basic components and optional components of a slab for the grain-oriented electrical steel sheet are as follows.

C: 0.08 mass % or less

C is added to improve the microstructure of the hot rolled sheet. However, if the content exceeds 0.08 mass %, it becomes difficult to reduce C to 50 mass ppm or less where magnetic aging does not occur during the manufacturing process. Therefore, the C content is preferably 0.08 mass % or less. Note that it is not necessary to set up a particular lower limit for the C content because secondary recrystallization is enabled in a material not containing C. In addition, the C content is reduced during decarburization annealing, where it is reduced to that of an inevitable impurity in a product sheet.

Si: 2.0 mass % to 8.0 mass %

Si is an element effective for enhancing the electrical resistance of the steel and improving the iron loss properties. However, if the content is less than 2.0 mass %, a sufficient iron loss reducing effect can not be obtained. On the other hand, when the content exceeds 8.0 mass %, the workability significantly deteriorates and the magnetic flux density also decreases. Therefore, the Si content is preferably in the range of 2.0 mass % to 8.0 mass %.

Mn: 0.005 mass % to 1.0 mass %

Mn is an element necessary to improve the hot workability. However, if the content is less than 0.005 mass %, the addition effect is poor. On the other hand, when the content exceeds 1.0 mass %, the magnetic flux density of a product sheet decreases. Therefore, the Mn content is preferably in the range of 0.005 mass % to 1.0 mass %.

In addition to the above basic components, the following elements may be appropriately contained as the components for improving the magnetic properties:

at least one selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Ni is an element useful for improving the microstructure of the hot rolled sheet and improving the magnetic properties. However, if the content is less than 0.03 mass %, the effect of improving the magnetic properties is small. On the other hand, if the content exceeds 1.50 mass %, secondary recrystallization becomes unstable and the magnetic properties deteriorate. Therefore, the Ni content is preferably in the range of 0.03 mass % to 1.50 mass %.

Further, Sn, Sb, Cu, P, Mo, and Cr are elements useful for improving the magnetic properties, yet if the content of each added element is below the lower limit described above, the effect of improving the magnetic properties is small. On the other hand, if the upper limit for each component described above is exceeded, the development of secondary recrystallized grains is inhibited. Therefore, the content of each added element is preferably in the above-described range.

The balance other than the above components is Fe and inevitable impurities mixed in the manufacturing process.

Next, a method of producing a grain-oriented electrical steel sheet according to the present disclosure will be described below.

[Heating]

The slab having the above-described chemical composition is heated according to a conventional method. The heating temperature is preferably in the range of 1150° C. to 1450° C.

[Hot Rolling]

After the heating, hot rolling is performed. Hot rolling may be performed immediately after casting without heating. In the case of a thin slab or thinner cast steel, hot rolling may be performed or omitted. In the case of performing hot rolling, it is preferable to set a rolling temperature at the rough rolling final pass to 900° C. or higher and a rolling temperature at the finish rolling final pass to 700° C. or higher.

[Hot Band Annealing]

Then, hot band annealing is optionally performed. At this time, in order to highly develop a Goss texture in a product sheet, the hot band annealing temperature is preferably set in the range of 800° C. to 1100° C. If the hot band annealing temperature is lower than 800° C., there remains a band texture resulting from hot rolling, which makes it difficult to obtain a primary recrystallization texture of uniformly-sized grains and impedes the growth of secondary recrystallization. On the other hand, if the hot band annealing temperature exceeds 1100° C., the grain size after hot band annealing coarsens excessively, which makes it extremely difficult to obtain a primary recrystallization texture of uniformly-sized grains.

[Cold Rolling]

Thereafter, cold rolling is performed once, or twice or more with intermediate annealing performed therebetween. The intermediate annealing temperature is preferably in the range of 800° C. or higher and 1150° C. or lower. The intermediate annealing time is preferably approximately in the range of 10 seconds to 100 seconds.

[Decarburization Annealing]

Then, decarburization annealing is performed. The decarburization annealing is preferably performed in the range of annealing temperature: 750° C. to 900° C., atmospheric oxidizability $PH_2O/PH_2$: 0.25 to 0.60, and annealing time: about 50 seconds to about 300 seconds.

[Application of Annealing Separator]

Then, an annealing separator is applied. In this case, the annealing separator preferably contains MgO as the main component and the coating amount is approximately in the range of 8 $g/m^2$ to 15 $g/m^2$.

[Final Annealing]

Then, final annealing is applied for the purpose of secondary recrystallization and formation of a forsterite film. The annealing temperature is preferably set to 1100° C. or higher, and the annealing time is preferably set to 30 minutes or more.

[Flattening Treatment and Insulating Coating]

After the final annealing, it is effective to carry out flattening annealing for shape adjustment. The flattening annealing is preferably performed at an annealing temperature of 750° C. to 950° C. for an annealing time of about 10 seconds to about 200 seconds.

According to the present disclosure, insulating coating is applied to the surface of the steel sheet before or after the flattening annealing. As used herein, the insulating coating means a coating (tensile coating) that applies tension to the steel sheet to reduce iron loss. Examples of the tension coating include a coating formed by applying and baking an inorganic coating containing silica, and a coating formed by forming a ceramic coating by a physical vapor deposition method, a chemical vapor deposition method, or the like.

[Magnetic Domain Refining Treatment]

Magnetic domain refining treatment which is one of the features of the present disclosure is applied to the grain-oriented electrical steel sheet thus obtained. There are two types of magnetic domain refining treatment: strain application type and groove formation type. In the present disclosure, strain application type-magnetic domain refining treatment is applied. Preferred conditions for this strain application type will be described below.

[[Strain Application Type-Magnetic Domain Refining Treatment]]

In the present disclosure, a high energy beam irradiation device is used as a strain application device. Examples of the high energy beam irradiation device include a laser beam irradiation device or an electron beam irradiation device. These devices are already widely used, and a general irradiation device can be appropriately used in the present disclosure. Further, as a light source of a laser, any of laser oscillation modes, a continuous wave laser or a pulse laser, can be suitably used, and a laser medium can be used regardless of the type, such as a YAG laser or a $CO_2$ laser. In particular, since the electron beam has a high ability to transmit a substance, it is possible to greatly change the amount of strain applied in the thickness direction. Therefore, when the strain distribution is three-dimensionally controlled as in the present disclosure, it is easy to control the strain distribution within a suitable range, which is preferable.

[[Number of Devices]]

The beam scanning speed and the beam scanning width are restricted by various factors, and it is often difficult to apply the magnetic domain refining treatment to the entire surface of the coil with a single device alone. In this case, the beam irradiation on the entire surface of the coil is performed using a plurality of irradiation devices in the sheet transverse direction. Since the present disclosure solves the above-mentioned problems that would otherwise occur when using a plurality of such irradiation devices, the magnetic domain refining treatment disclosed herein can preferably use two or more devices. However, a single device is also applicable in the case of discontinuous irradiation.

[[Method of Controlling the Strain Application Distribution]]

In the present disclosure, it is found that it is effective to use the closure domain overlapping ratio of the irradiation surface and the non-irradiation surface as a method of three-dimensionally grasping the strain application distribution in the vicinity of discontinuous regions. That is, in order to make the iron loss properties and the magnetostrictive properties in the vicinity of discontinuous regions comparable to those of regions without discontinuous regions, it is important to control the closure domain overlapping ratio of the irradiation surface and the non-irradiation surface and the closure domain overlapping width on the irradiation surface, i.e., $\alpha$ and $\beta$, so as to satisfy the following Expressions (1) and (2):

$$0.5 \leq \alpha \leq 5.0 \quad (1)$$

$$0.2\alpha \leq \beta \leq 0.8\alpha \quad (2),$$

where $\alpha$ denotes the overlapping width (in millimeters) of the lengths in the transverse direction of the narrower (closer) ones of the adjacent closure domains formed by different high energy beam irradiation devices, or the length (in millimeters) in the transverse direction of the overlapping portion of the formed closure domains, on the surface subjected to the high energy beam irradiation.

On the other hand, $\beta$ denotes the length (in millimeters) in the transverse direction of an overlapping portion corresponding to the above $\alpha$ of the adjacently-overlapping or overlapping closure domains formed by different high energy beam irradiation devices, on the high energy beam non-irradiation surface.

When three or more high energy beam irradiation devices are used, $\alpha$ and $\beta$ are respectively formed at a plurality of locations in the transverse direction of the steel sheet. However, $\beta$ is defined as the width of an overlapping portion on the non-irradiation surface generated by the formation of $\alpha$. The overlapping width $\alpha$ on the irradiation surface is larger than the overlapping width $\beta$ on the non-irradiation surface.

Here, the overlapping width $\alpha$ according to the present disclosure is preferably set to 1.0 mm or more.

As a method of controlling the overlapping width so as to satisfy the Expressions (1) and (2), it is preferable to change the parameters for controlling the focusing in accordance with the beam deflection position. Specifically, the parameters may be changed so as to achieve just focusing except in the vicinity of discontinuous regions, and so as to satisfy the above-described control range of the overlapping width in the vicinity of discontinuous regions. The parameters for controlling the focusing are not particularly limited, yet for example, in the case of electron beam irradiation, the current value of the focusing coil or the current value of a stigmatic meter coil may be changed, and in the case of laser irradiation, the position of the dynamic focus lens may be changed.

The current value and the like of the above-described stigmatic meter coil are not parameters for controlling the convergence of the electron beam, but parameters for changing the beam shape. However, considering the face that changing the aspect ratio of the beam shape changes the amount of strain applied to the steel sheet (for more effective strain application, it is preferable to make the beam shape closer to a perfect circle), these parameters can be considered as focusing adjustment parameters. As another method, it is also effective to change the beam output in accordance with the deflection position. Specifically, the closure domain overlapping widths in the transverse direction on the irradiation surface and the non-irradiation surface (i.e., overlapping width of the heat-affected parts) is controlled by adjusting the beam irradiation conditions such that in regions other than discontinuous regions, beam irradiation is performed with such an output as to achieve sufficient magnetic domain refining, while in the vicinity of discontinuous regions, the beam output is changed to the low side. At this time, control parameters of the beam output are not particularly limited, yet, for example, in the case of electron beam irradiation, examples include an acceleration voltage and a beam current, and in the case of laser irradiation, examples include a current command value used to control a laser oscillator.

[[Other Conditions]]

The average power P for laser irradiation to the steel sheet, the scanning speed V of the laser beam, the laser beam diameter d, and the like are not particularly limited, and may be combined so as to satisfy the above parameters according to the present disclosure. In order to obtain sufficient energy, however, it is preferable that the energy heat input P/V per unit length for scanning the laser beam be larger than 10 W·s/m.

In addition, the laser irradiation to the steel sheet may be continuously performed in a linear manner or may be in a dot-sequence manner. Here, in the case of pulse irradiation in a dot-sequence manner, a preferred pulse interval is 0.01 mm to 1.00 mm. In addition, in the case of performing pulse irradiation in a dot-sequence manner, one closure domain is formed from a plurality of dot-sequences formed thereby.

Note that the direction of an irradiation mark formed by a laser beam is a direction forming an angle of 30° or less with respect to the transverse direction of the steel sheet.

On the other hand, in the case of electron beam irradiation, the acceleration voltage E, the beam current I, and the beam velocity V are not particularly limited, and may be combined so as to satisfy the above parameters according to the present disclosure. In order to obtain a sufficient magnetic domain refining effect, however, it is preferable that the energy heat input (E×I/V) per unit length for scanning the beam be larger than 10 W·s/m. The vacuum degree at the time of electron beam irradiation is desirably 2 Pa or less. If the vacuum degree is worse than this (more than 2 Pa), the quality of the electron beam is degraded by the residual gas existing between the electron gun and the steel sheet, and the energy introduced into the steel sheet becomes smaller, making it impossible to obtain the desired magnetic domain refining effect.

Note that the direction of an irradiation mark formed by an electron beam is a direction forming an angle of 30° or less with respect to the transverse direction of the steel sheet.

The spot diameter of the laser beam and the electron beam is preferably approximately in the range of 0.01 mm to 0.3 mm, the repetition interval in the rolling direction is preferably approximately in the range of 3 mm to 15 mm in each device, and the irradiation direction is a direction forming an angle of preferably 60° to 120°, more preferably 85° to 95°, with respect to the rolling direction of the steel sheet. Note that the depth of strain applied to the steel sheet is preferably approximately in the range of 10 μm to 40 μm.

Manufacturing conditions other than those described above may follow a general method of producing a grain-oriented electrical steel sheet.

EXAMPLES

Example 1

A steel slab having a chemical composition containing C: 0.04 mass %, Si: 3.8 mass %, Mn: 0.1 mass %, Ni: 0.1 mass %, Al: 280 mass ppm, N: 100 mass ppm, Se: 120 mass ppm, and S: 5 mass ppm, with the balance being Fe and inevitable impurities, was prepared by continuous casting, heated to 1430° C., and then hot rolled into a hot-rolled sheet with a thickness of 2.0 mm, and then subjected to hot band annealing at 1100° C. for 20 seconds. Then, each steel sheet was subjected to cold rolling to have an intermediate sheet thickness of 0.40 mm, and then to intermediate annealing under the following conditions: atmospheric oxidizability $PH_2O/PH_2$=0.40, temperature=100° C., and duration=70 seconds. Subsequently, each steel sheet was subjected to pickling with hydrochloric acid to remove subscales from the surface, followed by cold rolling again to be finished to a cold-rolled sheet having a sheet thickness of 0.18 mm.

Then, decarburization annealing was performed in which each steel sheet was held at a soaking temperature of 820° C. for 300 seconds with an atmospheric oxidizability $PH_2O/PH_2$ of 0.44, then an annealing separator containing MgO as a main component was applied to the steel sheet, and then final annealing was carried out for the purposes of secondary recrystallization, formation of a forsterite film, and purification under the conditions of holding at 1160° C. for 10 hours. Then, an insulating coating made of 60% colloidal silica and aluminum phosphate was applied and baked at 850° C. This coating application process also serves as flattening annealing. Thereafter, a laser beam was irradiated at a right angle to the rolling direction to carry out non-heat resistant magnetic domain refining treatment. The conditions for the non-heat resistant magnetic domain refining treatment were as follows: six laser irradiation devices were used for a coil width of 1200 mm (where the deflection distance was equally divided), the laser light source was a continuous laser, the average power was 150 W, the beam diameter was 200 μm, the scanning speed was 10 m/sec, and the irradiation line interval was 3.5 mm.

The amount of strain applied in the periphery of the discontinuous regions was controlled by dynamically changing the position of the focusing coil in accordance with the deflection position (the irradiation position (in the sheet transverse direction) of the beam), i.e., by continuously changing the position of the focusing coil in accordance with the irradiation location, to thereby change the focusing. More specifically, the focusing conditions were determined beforehand in accordance with the irradiation locations of the steel sheet over 200 mm in the width direction, and the focusing at each irradiation location was changed to the determined conditions sequentially in accordance with the beam being continuously deflected in the width direction. In regions other than discontinuous regions, the position of the focusing coil was controlled to achieve "just focusing". On the other hand, in the periphery of discontinuous regions, the position setting of the focusing coil was changed to achieve various focusing conditions, including "under focusing" (which is a state in which the place at which the focal point is set (convergent position) is located above the steel sheet in the thickness direction, and in which the beam is out of focus at the position where the steel sheet is placed (i.e., strain is hardly applied)), "just focusing", and "upper focusing" (which is a state in which the place at which the place at which the focal point is set (convergent position) is located below the steel sheet in the thickness direction, and in which the beam is out of focus at the position where the steel sheet is placed (i.e., strain is hardly applied)). In this way, test materials having different strain application amounts (strain distribution) in the periphery of discontinuous regions were prepared. Then, 100 mm wide test materials including discontinuous regions and 100 mm wide samples not including discontinuous regions were collected, and the iron loss properties at 1.7 T and 50 Hz and the magnetostrictive vibration acceleration levels at 1.5 T and 50 Hz were evaluated.

Table 1 lists the closure domain overlapping width (in the TD direction) on the beam-irradiation surface, the closure domain overlapping ratio of the irradiation surface and the non-irradiation surface, the iron loss properties, and the magnetostrictive properties. In each sample with discontinuous regions controlled within the scope of the present disclosure, the iron loss properties and the magnetostrictive properties comparable or superior to those of samples without discontinuous regions were obtained. From this, it can be seen that the iron loss properties and the magnetostrictive properties were compatible in these samples. In contrast, in Nos. 11, 16, 20, 24, 28, and 29 to 36, control of the strain application amount was insufficient, and the magnetostrictive properties, which are highly strain sensitive, could not be properly controlled, although the iron loss properties were good. From this, it can be seen that the iron loss properties and the magnetostrictive properties were not compatible in these samples.

TABLE 1

| No. | Discontinuous portion | Closure domain overlapping width on irradiation surface (mm) | Overlapping ratio of irradiation surface and non-irradiation surface (non-irradiation surface/irradiation surface) | Iron loss $W_{17/50}$ (W/kg) | Magnetostrictive vibration acceleration level (1.5T, 50 Hz) | Remarks |
|---|---|---|---|---|---|---|
| 1 | none | — | — | 0.67 | 33.5 | Reference example (reference) |
| 2 | present | 0.2 | 0.20 | 0.74 | 25.0 | Comparative example |
| 3 | | | 0.50 | 0.72 | 27.0 | Comparative example |
| 4 | | | 1.00 | 0.70 | 31.0 | Comparative example |
| 5 | | 0.5 | 0.10 | 0.73 | 30.0 | Comparative example |
| 6 | | | 0.20 | 0.68 | 32.0 | Example |
| 7 | | | 0.30 | 0.68 | 33.0 | Example |
| 8 | | | 0.50 | 0.68 | 33.0 | Example |
| 9 | | | 0.70 | 0.68 | 34.0 | Example |
| 10 | | | 0.80 | 0.68 | 34.0 | Example |
| 11 | | | 0.90 | 0.68 | 37.0 | Comparative example |
| 12 | | 1.5 | 0.10 | 0.72 | 30.0 | Comparative example |
| 13 | | | 0.30 | 0.67 | 32.0 | Example |
| 14 | | | 0.50 | 0.67 | 33.0 | Example |
| 15 | | | 0.70 | 0.67 | 34.0 | Example |
| 16 | | | 0.90 | 0.67 | 38.0 | Comparative example |
| 17 | | 3.0 | 0.15 | 0.71 | 33.0 | Comparative example |
| 18 | | | 0.35 | 0.67 | 33.0 | Example |
| 19 | | | 0.75 | 0.67 | 34.0 | Example |
| 20 | | | 0.95 | 0.68 | 42.0 | Comparative example |
| 21 | | 4.5 | 0.25 | 0.67 | 33.0 | Example |
| 22 | | | 0.45 | 0.67 | 33.0 | Example |
| 23 | | | 0.65 | 0.67 | 33.5 | Example |
| 24 | | | 0.85 | 0.67 | 37.0 | Comparative example |
| 25 | | 5.0 | 0.10 | 0.71 | 33.0 | Comparative example |
| 26 | | | 0.35 | 0.67 | 34.0 | Example |
| 27 | | | 0.75 | 0.67 | 34.0 | Example |
| 28 | | | 0.90 | 0.67 | 41.0 | Comparative example |
| 29 | | 5.5 | 0.15 | 0.67 | 37.0 | Comparative example |
| 30 | | | 0.35 | 0.67 | 39.0 | Comparative example |
| 31 | | | 0.75 | 0.67 | 42.0 | Comparative example |
| 32 | | | 0.95 | 0.67 | 45.0 | Comparative example |
| 33 | | 8.0 | 0.20 | 0.70 | 42.0 | Comparative example |
| 34 | | | 0.40 | 0.72 | 44.0 | Comparative example |
| 35 | | | 0.60 | 0.73 | 45.0 | Comparative example |
| 36 | | | 0.80 | 0.74 | 47.0 | Comparative example |

Example 2

A steel slab having a chemical composition containing C: 0.05 mass %, Si: 3.0 mass %, Mn: 0.5 mass %, Ni: 0.01 mass %, Al: 60 mass ppm, N: 33 mass ppm, Se: 10 mass ppm, and S: 5 mass ppm, with the balance being Fe and inevitable impurities, was prepared by continuous casting, heated to 1200° C., and then hot rolled into a hot-rolled sheet with a thickness of 2.7 mm, and then subjected to hot band annealing in which the hot-rolled sheet was held at 950° C. for 180 seconds. Then, it was cold-rolled into a cold-rolled sheet with a thickness of 0.23 mm.

Then, decarburization annealing was performed in which each steel sheet was held at a soaking temperature of 820° C. for 300 seconds with an atmospheric oxidizability $PH_2O/PH_2$ of 0.58, then an annealing separator containing MgO as a main component was applied to the steel sheet, and then final annealing was carried out for the purposes of secondary recrystallization, formation of a forsterite film, and purification under the conditions of holding at 1250° C. for 100 hours. Then, an insulating coating made of 60% colloidal silica and aluminum phosphate was applied and baked at 800° C. This coating application process also serves as flattening annealing. Thereafter, an electron beam was irradiated at a right angle to the rolling direction to carry out non-heat resistant magnetic domain refining treatment. The conditions for the non-heat resistant magnetic domain refining treatment were as follows: eight electron beam irradiation devices were used for a coil width of 1200 mm (where the deflection distance was equally divided), the acceleration voltage was 200 kV, the beam current was 9 mA, the beam diameter was 80 μm, the scanning speed was 100 m/sec, and the irradiation line interval was 5.5 mm.

The amount of strain applied in the periphery of discontinuous regions was controlled by dynamically changing the current value of the focusing coil or the stigmatic meter coil, i.e., by continuously changing the current value of the focusing coil to be controlled in accordance with the irradiation location, to thereby change the focusing. In regions other than discontinuous regions, the current value was set so as to achieve just focusing (a condition in which strain is most easily applied), and in the periphery of discontinuous regions, various current values were set in order to change the strain application conditions, not limited to the just focusing condition. Then, 100 mm wide test materials including discontinuous regions and 100 mm wide test materials not including discontinuous regions were collected, and the iron loss properties at 1.7 T and 50 Hz and the magnetostrictive vibration acceleration levels at 1.5 T and 50 Hz were evaluated.

Table 2 lists the closure domain overlapping width (in the TD direction) on the beam-irradiation surface, the closure domain overlapping ratio on the irradiation surface and the non-irradiation surface, the iron loss properties, and the magnetostrictive properties. In each sample with discontinuous regions controlled within the scope of the present disclosure, the iron loss properties and the magnetostrictive properties comparable or superior to those of samples without discontinuous regions were obtained. From this, it can be seen that the iron loss properties and the magnetostrictive properties were compatible in these samples. In contrast, in Nos. 9, 13, 17, and 18 to 21, control of the strain application amount was insufficient, and the magnetostrictive properties, which are highly strain sensitive, could not be properly controlled, although the iron loss properties were good. From this, it can be seen that the iron loss properties and the magnetostrictive properties were not compatible in these samples.

conditions for the non-heat resistant magnetic domain refining treatment were as follows: eight electron beam irradiation devices were used for a coil width of 1200 mm (where the deflection distance was equally divided), the accelerating voltage was 60 kV, the beam diameter was 300 μm, the scanning speed was 20 m/sec, and the irradiation line interval was 8 mm.

The amount of strain applied in the periphery of discontinuous regions was controlled by dynamically changing the beam current in accordance with the deflection position. Specifically, the beam current was set to 6 mA in regions other than discontinuous regions. In the periphery of discontinuous regions, the beam current value was controlled such that the beam current value was set to a value at the end of deflection, and when reaching a overlapping portion (closure domain overlapping portion), it was linearly changed from the current value set for regions other than discontinuous regions to the beam current at the end of deflection. By changing the beam current at the end of deflection variously, it is possible to change the strain distribution in the periphery of discontinuous regions. Then, 100 mm wide test materials including discontinuous regions and 100 mm wide test materials not including discontinuous regions were collected, and the iron loss properties at 1.7 T and 50 Hz and the magnetostrictive vibration acceleration levels at 1.5 T and 50 Hz were evaluated.

TABLE 2

| No. | Discontinuous portion | Control coil | Closure domain overlapping width on irradiation surface (mm) | Overlapping ratio of irradiation surface and non-irradiation surface (non-irradiation surface/ irradiation surface) | Iron loss $W_{17/50}$ (W/kg) | Magnetostrictive vibration acceleration level (1.5T, 50 Hz) | Remarks |
|---|---|---|---|---|---|---|---|
| 1 | none | Focusing coil | — | — | 0.74 | 31.0 | Reference example (reference) |
| 2 | present | Focusing coil | 0.2 | 0.20 | 0.81 | 22.5 | Comparative example |
| 3 | | | | 0.50 | 0.79 | 24.5 | Comparative example |
| 4 | | | | 1.00 | 0.77 | 28.5 | Comparative example |
| 5 | | Focusing coil | 1.5 | 0.10 | 0.79 | 27.5 | Comparative example |
| 6 | | | | 0.30 | 0.74 | 29.5 | Example |
| 7 | | | | 0.50 | 0.74 | 30.5 | Example |
| 8 | | | | 0.70 | 0.74 | 31.5 | Example |
| 9 | | | | 0.90 | 0.74 | 35.5 | Comparative example |
| 10 | | Focusing coil | 3.0 | 0.15 | 0.78 | 30.5 | Comparative example |
| 11 | | | | 0.35 | 0.74 | 30.5 | Example |
| 12 | | | | 0.75 | 0.74 | 31.5 | Example |
| 13 | | | | 0.95 | 0.75 | 39.5 | Comparative example |
| 14 | | Stigmatic meter coil | 4.5 | 0.25 | 0.74 | 30.5 | Example |
| 15 | | | | 0.45 | 0.74 | 30.5 | Example |
| 16 | | | | 0.65 | 0.74 | 31.0 | Example |
| 17 | | | | 0.85 | 0.74 | 34.5 | Comparative example |
| 18 | | Stigmatic meter coil | 5.5 | 0.15 | 0.74 | 34.5 | Comparative example |
| 19 | | | | 0.35 | 0.74 | 36.5 | Comparative example |
| 20 | | | | 0.75 | 0.74 | 39.5 | Comparative example |
| 21 | | | | 0.95 | 0.74 | 42.5 | Comparative example |
| 22 | | Focusing coil | 8.0 | 0.20 | 0.77 | 39.5 | Comparative example |
| 23 | | | | 0.40 | 0.79 | 41.5 | Comparative example |
| 24 | | | | 0.60 | 0.80 | 42.5 | Comparative example |
| 25 | | | | 0.80 | 0.81 | 44.5 | Comparative example |

Example 3

A steel slab having a chemical composition containing C: 0.01 mass %, Si: 3.5 mass %, Mn: 0.15 mass %, Ni: 0.05 mass %, Al: 270 mass ppm, N: 100 mass ppm, Se: 5 mass ppm, and S: 60 mass ppm, with the balance being Fe and inevitable impurities, was prepared by continuous casting, heated to 1380° C., and then hot rolled into a hot-rolled sheet with a thickness of 1.8 mm, and then subjected to hot band annealing in which the hot-rolled sheet was held at 1100° C. for 180 seconds. Then, it was cold-rolled into a cold-rolled sheet with a thickness of 0.27 mm.

Then, decarburization annealing was performed in which each steel sheet was held at a soaking temperature of 860° C. for 100 seconds with an atmospheric oxidizability $PH_2O/PH_2$ of 0.45, then an annealing separator containing MgO as a main component was applied to the steel sheet, and then final annealing was carried out for the purposes of secondary recrystallization, formation of a forsterite film, and purification under the conditions of holding at 1200° C. for 60 hours. Then, an insulating coating made of 40% colloidal silica and aluminum phosphate was applied and baked at 820° C. This coating application process also serves as flattening annealing. Thereafter, an electron beam was irradiated at a right angle to the rolling direction to carry out non-heat resistant magnetic domain refining treatment. The Table 3 lists the closure domain overlapping width (in the TD direction) on the beam-irradiation surface, the closure domain overlapping ratio on the irradiation surface and the non-irradiation surface, the iron loss properties, and the magnetostrictive properties. In each sample with discontinuous regions controlled within the scope of the present disclosure, the iron loss properties and the magnetostrictive properties comparable or superior to those of samples without discontinuous regions were obtained. From this, it can be seen that the iron loss properties and the magnetostrictive properties were compatible in these samples.

TABLE 3

| No. | Discontinuous portion | Closure domain overlapping width on irradiation surface (mm) | Overlapping ratio of irradiation surface and non-irradiation surface (non-irradiation surface/irradiation surface) | Iron toss $W_{17/50}$ (W/kg) | Magnetostrictive vibration acceleration level (1.5T, 50 Hz) | Remarks |
|---|---|---|---|---|---|---|
| 1 | none | — | — | 0.86 | 28.0 | Reference example (reference) |
| 2 | present | 1.5 | 0.10 | 0.94 | 24.0 | Comparative example |
| 3 | | | 0.30 | 0.86 | 28.0 | Example |
| 4 | | | 0.50 | 0.86 | 28.0 | Example |
| 5 | | | 0.70 | 0.86 | 28.5 | Example |
| 6 | | | 0.90 | 0.86 | 32.0 | Comparative example |
| 7 | | 4.5 | 0.25 | 0.86 | 27.5 | Example |
| 8 | | | 0.45 | 0.86 | 28.0 | Example |
| 9 | | | 0.65 | 0.86 | 28.0 | Example |
| 10 | | | 0.85 | 0.86 | 31.0 | Comparative example |

REFERENCE SIGNS LIST

1 closure domain
2 closure domain A
3 closure domain adjacent to closure domain A

The invention claimed is:

1. A grain-oriented electrical steel sheet comprising:

closure domains, each closure domain containing a discontinuous region at a part thereof and each closure domain extending at an angle within 30° with respect to a transverse direction of the steel sheet; an irradiation surface having been irradiated with a high energy beam; and a non-irradiation surface opposed to the irradiation surface and having not been irradiated with the high energy beam, wherein a closure domain overlapping portion in the discontinuous region on the irradiation surface of the steel sheet has a length α in millimeters (mm) in the transverse direction that is longer than a length β in mm in the transverse direction of a corresponding closure domain overlapping portion on the non-irradiation surface of the steel sheet, and the length α in mm satisfies the following Expression (1) and the length β in mm satisfies the following Expression (2):

$$0.5\ (\text{mm}) \leq \alpha\ (\text{mm}) \leq 5.0\ (\text{mm}) \quad (1)$$

$$0.2\alpha\ (\text{mm}) \leq \beta\ (\text{mm}) \leq 0.8\alpha\ (\text{mm}) \quad (2).$$

2. A method of producing the grain-oriented electrical steel sheet according to claim 1, comprising: irradiating the steel sheet with a high energy beam from each of a plurality of high energy beam irradiation devices to form the closure domains, wherein in each of the high energy beam irradiation devices, at least one of focusing and output of high energy beam is adjusted to satisfy the Expressions (1) and (2).

3. The method of producing a grain-oriented electrical steel sheet according to claim 2, wherein the high energy beam is a laser beam or an electron beam.

* * * * *